United States Patent [19]

Showers et al.

[11] Patent Number: 4,690,433

[45] Date of Patent: Sep. 1, 1987

[54] STATIONERY SET

[75] Inventor: David F. Showers, Malvern; Raymond A. James, Bulleen, both of Australia

[73] Assignee: Glenwood Systems U.S.A., Ltd., Australia

[21] Appl. No.: 738,755

[22] Filed: May 29, 1985

[30] Foreign Application Priority Data

May 30, 1984 [AU] Australia ..... PG5270

[51] Int. Cl.[4] ..... B42B 15/00; B41L 1/20; B41L 1/24; B65D 27/00

[52] U.S. Cl. ..... 283/1 B; 282/9 R; 282/27 A; 229/92.1

[58] Field of Search ..... 283/1 B; 282/3 B, 8 B, 282/9 A, 11.5 R, 22 A, 23 R, 23 A, 24, 27 A, 25, 9 R, 27; 229/92.1, 92.3, 92.4

[56] References Cited

U.S. PATENT DOCUMENTS

| | | | |
|---|---|---|---|
| 1,296,059 | 3/1919 | Fenn | 283/1 B |
| 1,413,123 | 4/1922 | Kearney | 283/1 B |
| 1,424,837 | 8/1922 | Lover | 282/9 R |
| 1,757,094 | 5/1930 | Pollak | 282/27 A |
| 2,118,064 | 5/1938 | Baechle | 283/1 B |
| 3,124,300 | 3/1964 | Vonderscher | 229/92.1 |

FOREIGN PATENT DOCUMENTS

| | | |
|---|---|---|
| 524170 | 9/1979 | Australia . |
| 3038687 | 5/1982 | Fed. Rep. of Germany . |
| 141056 | 9/1930 | Switzerland . |
| 2043534 | 10/1980 | United Kingdom . |

*Primary Examiner*—E. R. Kazenske
*Assistant Examiner*—Paul M. Heyrana, Sr.
*Attorney, Agent, or Firm*—Hill, Van Santen, Steadman & Simpson

[57] ABSTRACT

A composite mailable business record and envelope assembly requiring only single manual entries to produce an original enclosed in an envelope and a retained record copy has only a single sheet foldable into three page sections to produce an addressed envelope with entries retained on the record page. The record page has a tab end for retaining in a book or the like.

9 Claims, 6 Drawing Figures

STATIONERY SET

This invention relates to a stationery set which has particular although by no means exclusive application to the issuance and settlement of infringement notices, accounts and the like.

It is an objective of the invention to facilitate the settlement of "on-the-spot" infringement notices, accounts and the like so as to induce the recipient to promptly forward his remittance to the issuing authority. As will be readidly apparent, however, the invention has very wide application beyond this specific objective.

The invention provides a stationery set comprising:

a first page printed with text and a first set of data entry zones;

a second page connected to the first page and printed on a severable portion thereof with a second set of data entry zones, at least some data entry zones of said sets being in register when the two pages lie one on the other;

a third page connected to the first page along a fold line;

means whereby the first and third pages may be folded and sealed up as an envelope about said portion of the second page with said portion projecting from an open end of the envelope; and means to facilitate severance of said portion of the second page from the set.

Preferably, said means to facilitate severance of said portion of the second page comprises a line of weakness, for example a perforation or series of slits, extending, for example, "down the page" with respect to said text. The severable portion typically comprises most of the second page and may comprise the whole of the second page. In the former case, a residual elongate portion of the second page provides a flap sealable to the third page in the formation of the envelope.

The stationary set conveniently comprises a single sheet of paper folded to form said pages. The second and/or third pages are preferably such that an impression on one is transferred to the other. For example, the first page may have an underlying carbon layer or may be formed of NCR paper. In use, the second page may thereby be retained as an office copy of the transaction, while the first and third pages may be employed by the recipient as a return envelope. The original written copy of the transaction is on the outside back of the envelope.

The first and third pages may be arranged to be folded into and sealed up as an envelope by virtue of complementary dimensions, and of means including co-operating tabs and/or flaps on the pages and suitable portions of adhesive or adhesively interactive material.

The invention further provides a stationery set comprising:

an envelope open at least one end; and a sheet within said envelope, said sheet including a substantial portion within the envelope and a portion projecting from the open end of the envelope.

Said sheet and a face of the envelope preferably have complementary text and means whereby an impression on one is transferred to the other. In a particularly advantageous aspect, the invention is also directed to an assembly or book of said stationery sets in which the projecting portions are bound or otherwise secured together to form the book or assembly.

It is highly preferred but not essential that said sheet be severably attached to and within said envelope, for example by a line of weakness such as a line of perforations or a series of slits, advantageously extending perpendicularly to the open end of the envelope.

The invention will now be further described, by way of example only, with reference to the accompanying drawings in which.

Figure 1A:
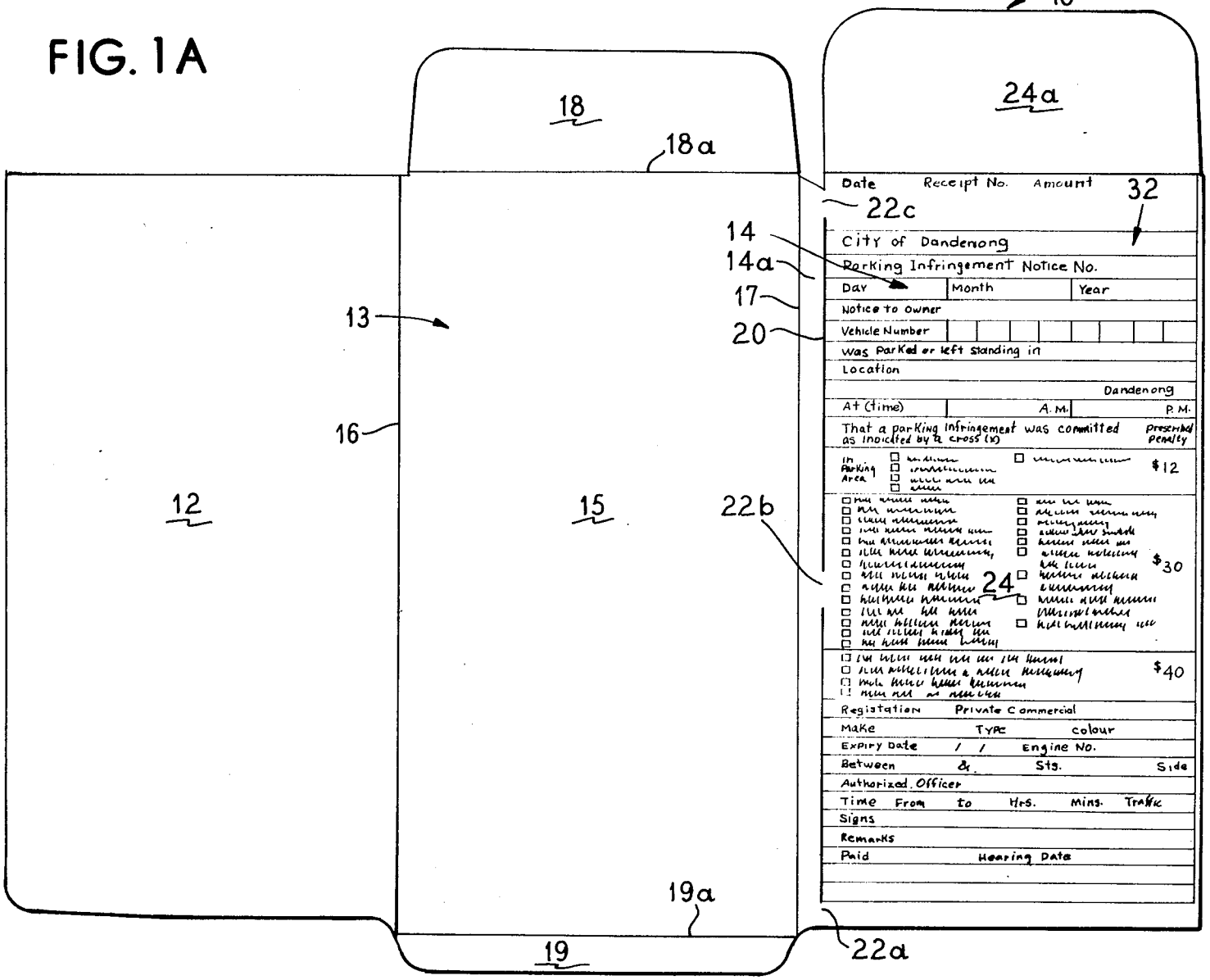
FIGS. 1A and 1B depicts the respective faces of a parking infringement notice formed as a stationery set in accordance with the invention, shown in its opened out condition.

The stationery set illustrated in FIG. 1 essentially comprises a single, folded sheet of paper 10 divided by a pair of parallel fold lines 16, 17 into three rectangular pages 12, 13, 14 of broadly similar size.

Page 13 further includes a pair of end flaps 18, 19 which extend beyond the end edges of page 13, and which may also be folded in upon the envelope along fold lines 18*a*, 19*a*.

Page 14 has a lengthwise line of weakness 20 that extends parallel to and quite close to fold line 17 and comprises a pair of co-linear slits separated from each other and from the end edges of the page by small contiguous portions 22*a*, 22*b*, 22*c*. The bulk of page 14, indicated in the drawings as portion 24, is thus readily severable from the rest of the set, leaving a narrow residual flap 14*a* along one side of page 12. It will be noted that at the top of page 14, severable portion 24 projects well beyond even tap 18 to define a segment 24*a* which does not overlie any other part of the set when the set is folded down to its compact envelope condition.

Page 13 carries a sheet or layer of carbon or other sensitised medium 15 on its inside face so that an impression made on the outside face of the page is transferred to page 14. Alternatively, page 13 or the whole sheet may be formed in carbonless/NCR (no carbon required) copy paper.

Pages 12, 13 are together so dimensioned that they may be folded into and sealed up as an envelope about portion 24 of page 14 with segment 24*a* of such portion projecting from an open end of the envelope. The inside faces of flaps 14*a*, 18, 19 are provided with suitable deposits of adhesive. The adhesive may, for example, be water activated strips or spots, or gummed strips covered by removable overlays. During use of the set, page 12 is folded over severable portion 24*a* and sealed to flap 14*a*, and flap 19 folded and sealed onto the outside face of page 12. When the envelope is subsequently separated from portion 24*a*, in circumstances to be described, flap 18 may be folded over to fully seal the envelope.

Figure 1B:
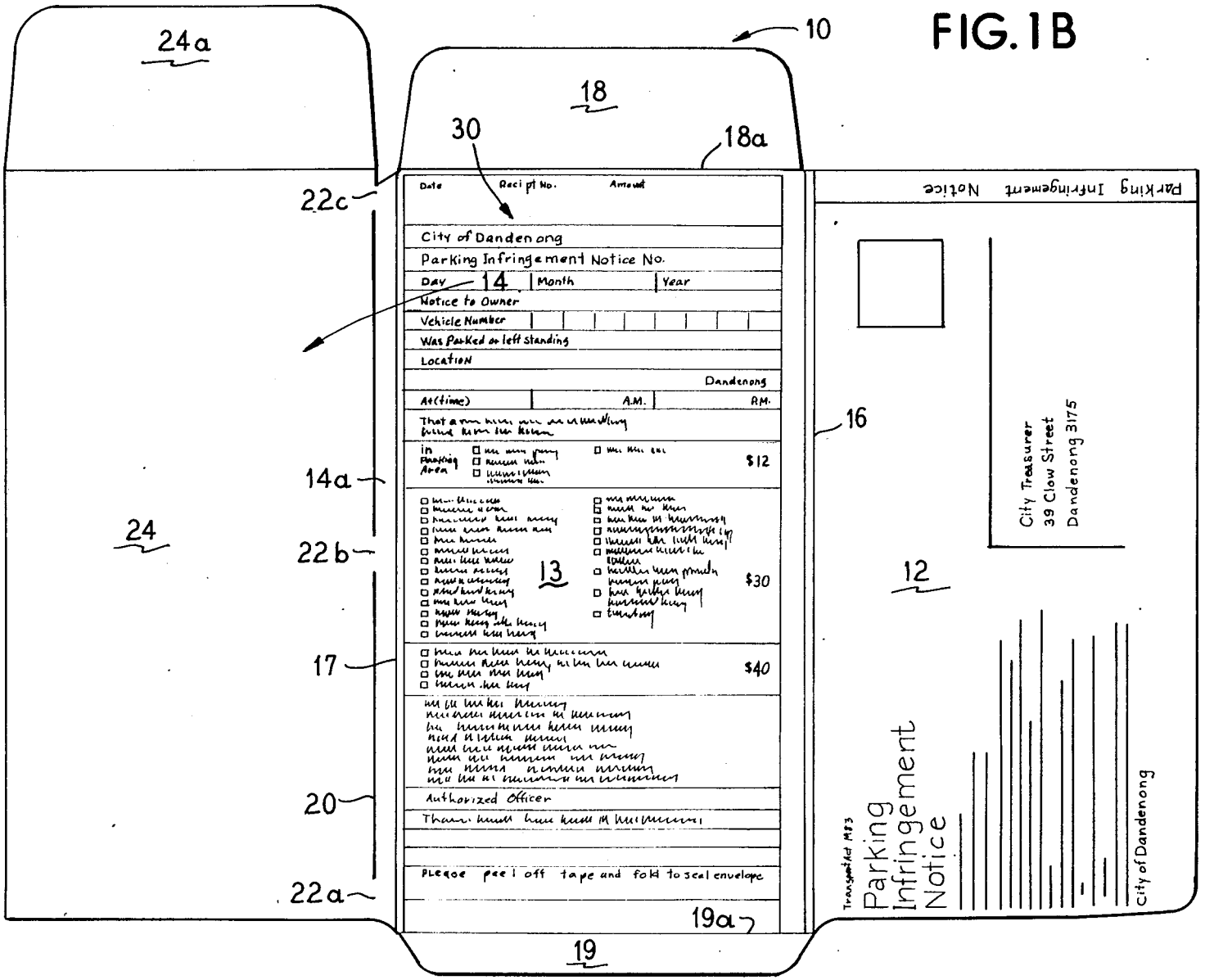

In the illustrated example, the stationery set is printed as a parking infringement notice. To this end, the outside face of center page 13 contains the statutory form of notice 30 addressed to the owner of the vehicle. As depicted in FIG. 1B, it contains both text and data entry zones, the latter including larger zones in the upper section of the notice for particulars of, for example, date, vehicle and location, small tick boxes in the centre for indicating the nature of the offence, and a lower box for the signature of the by-laws officer. Complementing this notice and printed on the inside face of page 14 is the office copy 32 of the notice, which contains identical upper and middle sections but a lower section in which the by-laws officer records other information for the local authority's records. The corresponding data entry zones on the two pages are in register when they are folded one onto the other so that, by virtue of carbon layer 15, the by-laws officer makes entries on the underlying sheet by simply writing on the top sheet. Sheet 13 is printed on its outside face with the address of the issuing local authority, a stamp box, and, in accordance with a statutory formula, with instructions regarding payment of the penalty.

Figure 2A:
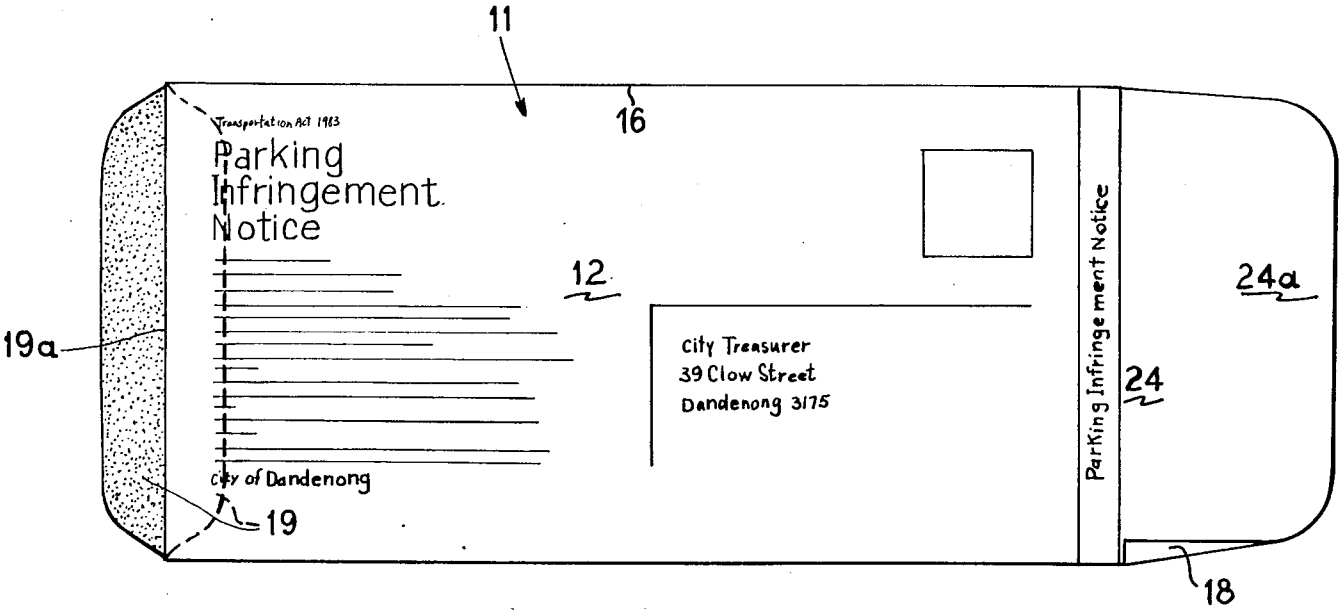
FIG. 2A and 2B show two steps in the utility of the set of FIG. 1.
Figure 2B:
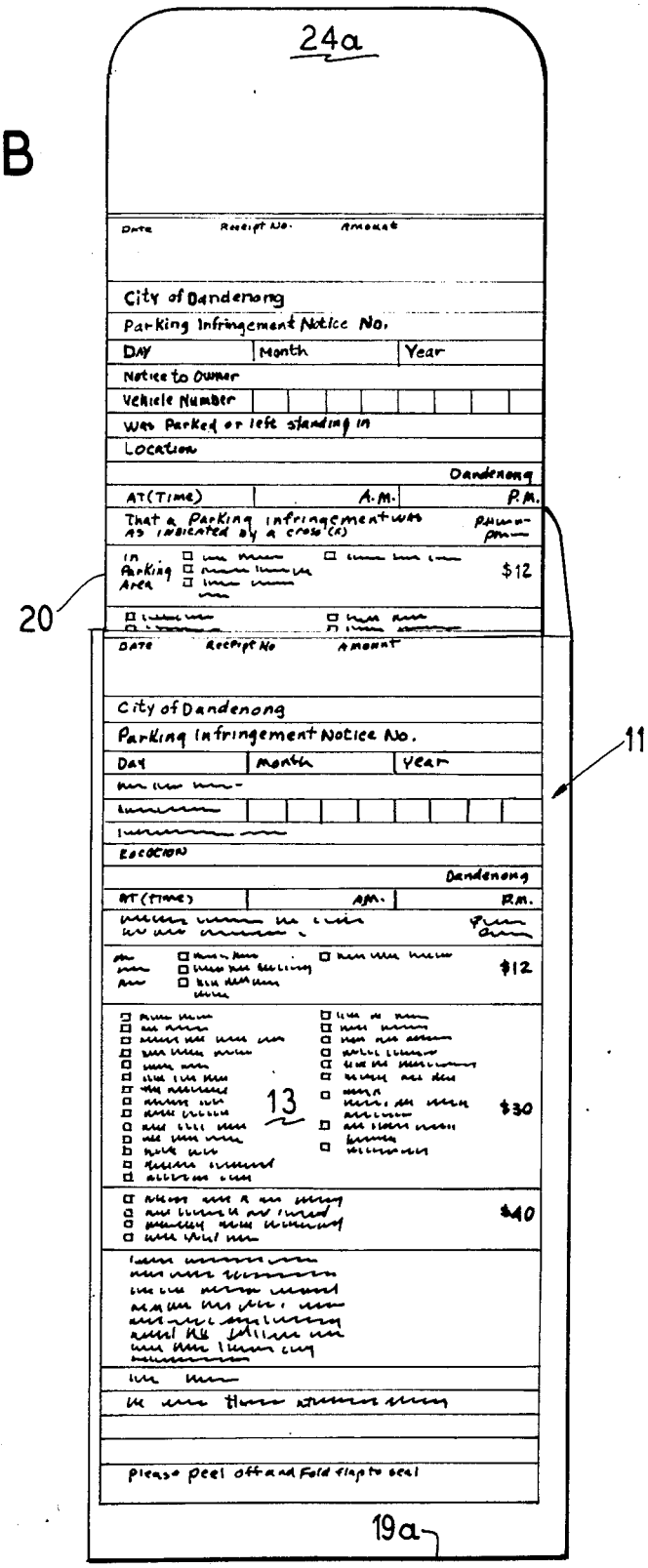

Multiple stationery sets folded and sealed as shown in FIG. 2A are assembled for use in a workbook for a local authority by-laws officer by binding together the upper overhanging segments 24*a* of portions 24 with the original infringement notice, in effect the back of envelope 11, facing upwards. When he comes to book a vehicle, the by-laws officer writes particulars of the infringement onto the formal notice 30, and thereby automatically onto the office copy 32. By gripping the bottom of envelope 11 (at flap 19) and pulling it longitudinally, the officer then divides the set along line of weakness 20 (FIG. 2B). The office copy 32 on portion 24 of page 14, remains, severed from the set, in his book for authority records. After disposing of carbon layer 15 (if necessary) and completing the lower boxes on copy 32, the officer now places the residual portion of the set 10, viz open-ended envelope 11, under the vehicle's windscreen wiper. The vehicle owner can simply write his cheque, seal it up within the envelope thereby provided by closing flap 18, add a postage stamp, and mail it back to the local authority.

If desired, the outside face of page 12, or some other suitable face of the set, may be printed in a very bright or luminescent colour to draw prompt and continuing attention to the notice.

Figure 3A:
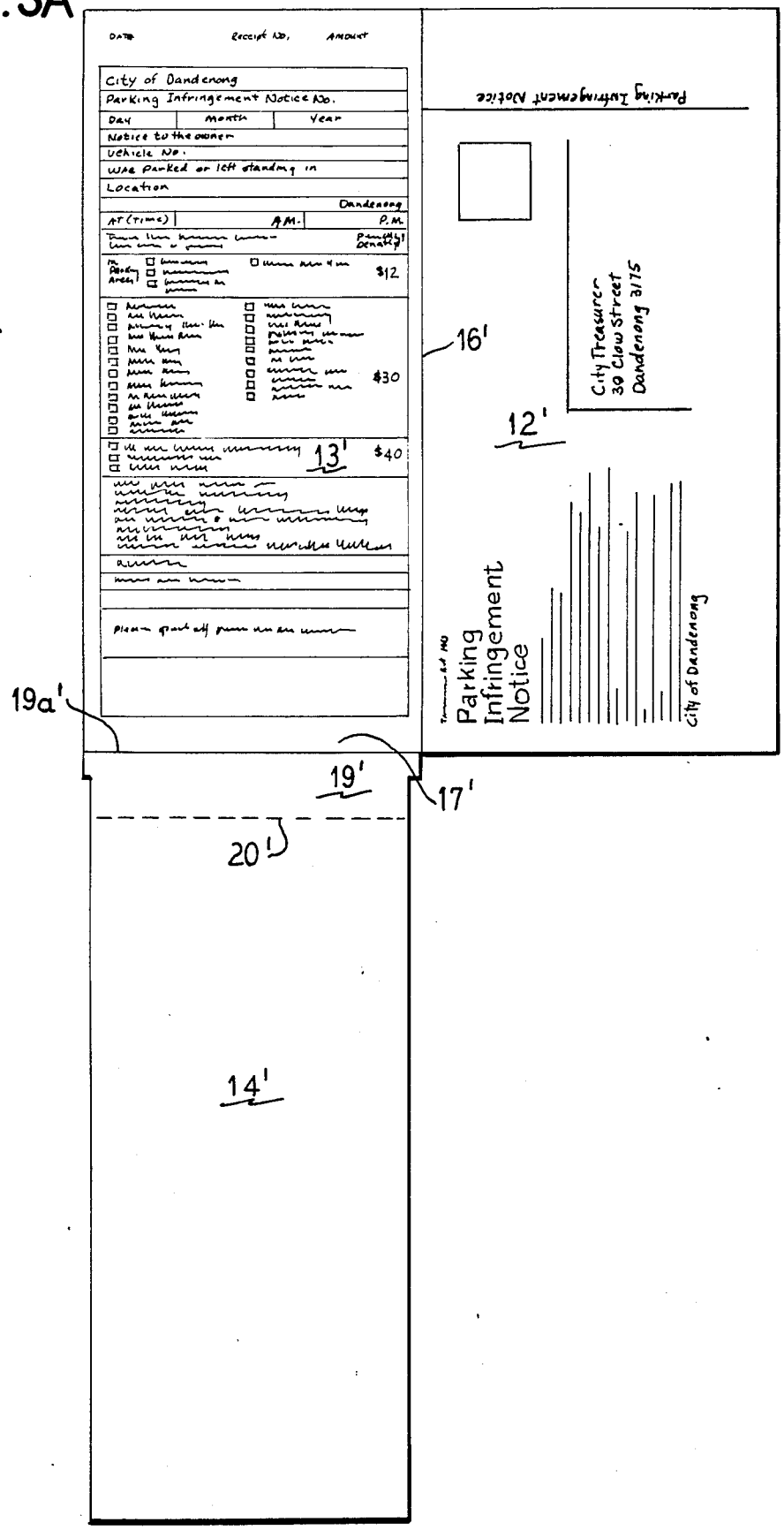
FIGS. 3A and 3B are views similar to FIGS. 1A and 1B of a second embodiment of stationery set according to the invention, like parts being indicated by like reference numerals.
Figure 3B:
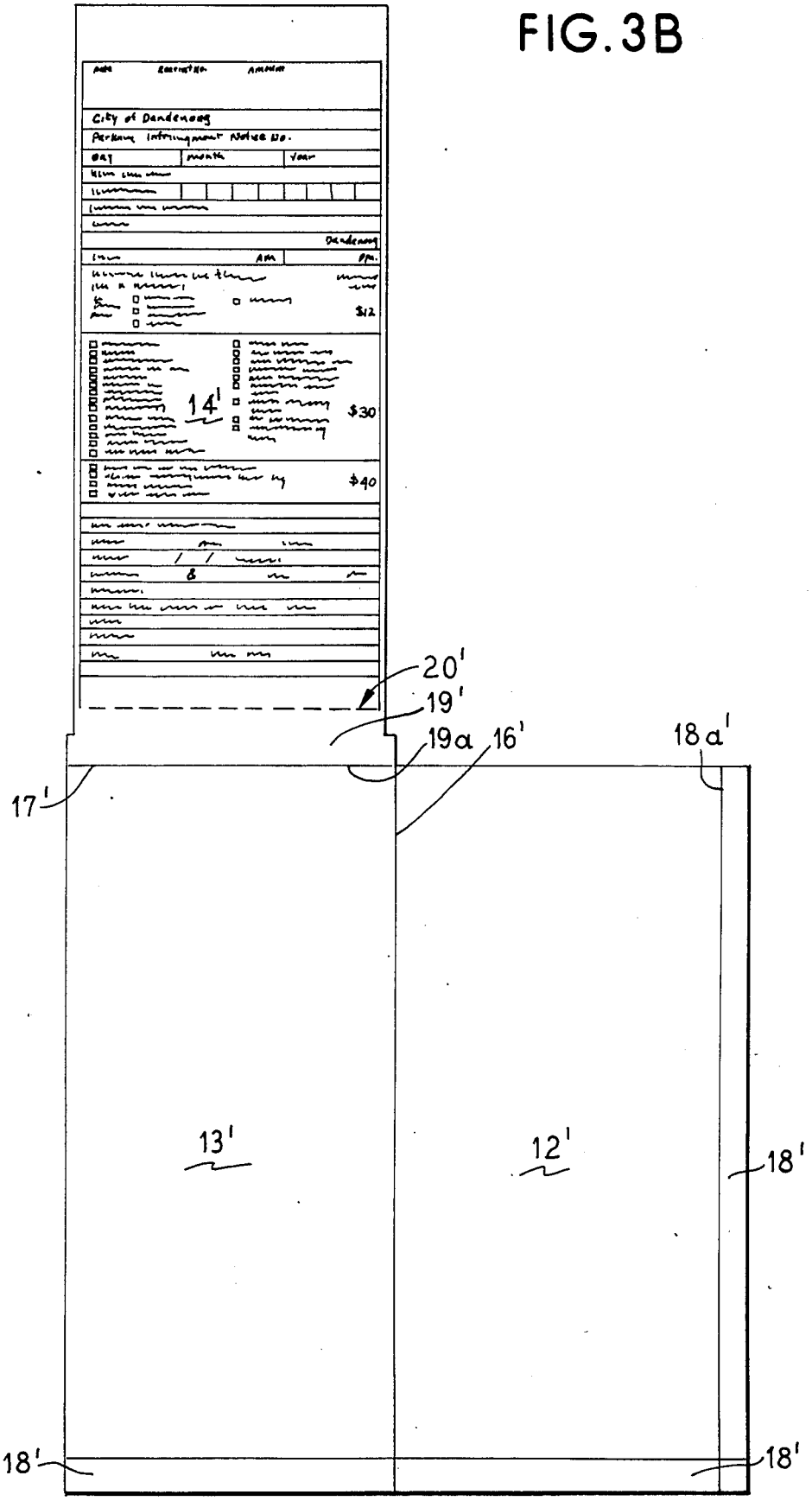

An alternative embodiment of stationery set is depicted in FIG. 3, in which like parts are indicated by like reference numerals. The difference of substance is that the page 14′ is attached by a perforation to one end rather than one side of centre page 12′. This embodiment is a little more complicated in handling in that the envelope is not even partially sealed up and in that the by-laws officer must fold over his book and open out the office copy pages in order to sever off the rest of the set for placement on the vehicle.

As already foreshadowed, it is not essential for page 14 to be actually attached to page 13 within the open-ended envelope. Moreover, the open-ended envelope, either separately or in the workbook, may include both a severably attached sheet and a loose sheet and/or two or more loose sheets, and/or two or more severably attached sheets, for example arranged in a successive array side-by-side or end-to-end.

The described arrangement has been advanced merely by way of explanation and many modifications may be made thereto without departing from the spirit and scope of the invention which includes every novel feature and combination of novel features herein disclosed.

I claim as my invention:

1. A mailable business single sheet form requiring only single entries producing a retained record page and a notice page foldable into an envelope sealed by the addressor which comprises a first page having printed indicia and cooperating blank spaces to be filled in by the person giving the notice, an underlying second page having indicia and blank spaces registering with the first page, means reproducing entries in the blank spaces of the first page of the blank spaces of the second page, a third page hinged to one of said first and second pages having an address printed thereon, gummed flaps on at least one of the hinged together pages to close the pages into an envelope with the address and entries exposed on opposite faces of the envelope, a projecting tab on a page receiving the entries to provide the record page, and means for separating the envelope forming pages from the record page.

2. The sheet form of claim 1 wherein the three pages are folded along lines parallel with each other.

3. The sheet form of claim 1 including longitudinal and transverse fold lines connecting the pages.

4. A stationery set which forms from a single sheet of paper an end opening envelope with an address printed on the front face thereof, a notice with entry spaces on the back face thereof and a retained duplicate of the notice between said front and back faces of the envelope which comprises a single sheet of paper having three panels connected in series by two fold lines, a first panel having address indicia printed on one face of the sheet, a second panel having notice indicia and entry spaces printed on the same face of the sheet as the first panel, a third panel between the first and second panels having printed on the opposite face of the sheet indicia and entry spaces underlying and registering with the indicia and entry spaces of the second panel, means reproducing entries on the second panel to the third panel, an end flap on said third panel projecting beyond the first and second panels, and end flap on said second panel partially overlapping the end flap on the third panel, an end tab on the second panel depending below the first panel, a tear line separating the second and third panels in spaced parallel relation beyond the fold line between the second and third panels, a side tab adjacent said tear line on said second panel, glue on the tabs of the second panel whereby the projecting flap on the third panel is adapted to be retained, the envelope forming panels pulled from the retained third panel and torn therefrom along said tear line, and the tabs of the second panel folded over and glued to close one end and one side of the envelope leaving an open end to be closed by the end flap on the second panel.

5. The stationery set of claim 4 wherein the two fold lines are parallel to each other.

6. The stationery set of claim 4 wherein the two fold lines are in right angular relation to each other.

7. The stationery set of claim 4 wherein the indicia on the second and third panels are parking infringement notices.

8. The stationery set of claim 4 wherein the tear line is composed of elongated slits between narrow connecting sections.

9. The stationery set of claim 4 wherein the tear line is easily severed by pulling the envelope forming panels away from the flap end of the retained panel.

* * * * *